United States Patent [19]

Atwater

[11] 4,422,200

[45] Dec. 27, 1983

[54] TEXTILE SPINDLE CLEANING APPARATUS

[76] Inventor: William M. Atwater, 114 E. Salisbury St., Pittsboro, N.C. 27312

[21] Appl. No.: 419,049

[22] Filed: Sep. 16, 1982

[51] Int. Cl.[3] ..... A46B 13/02

[52] U.S. Cl. ..... 15/21 D; 15/21 E; 15/88; 51/103 R; 51/236

[58] Field of Search ..... 15/21 D, 21 E, 88, 104.04; 29/81 F, 81 H; 51/103 R, 105, 236

[56] References Cited

U.S. PATENT DOCUMENTS

| | | | |
|---|---|---|---|
| 2,385,039 | 9/1945 | Steinmetz | 15/21 D |
| 2,739,326 | 3/1956 | Martin | 15/21 D |
| 2,832,084 | 4/1958 | McCollough, Jr. | 15/21 E |
| 3,290,830 | 12/1966 | Ono | 51/103 R |

*Primary Examiner*—Edward L. Roberts
*Attorney, Agent, or Firm*—B. B. Olive

[57] ABSTRACT

A cleaning apparatus for textile machine spinning roller spindles removes deposits of old glue and debris from the outer ends of the spindles once the old cots have been removed and prior to glueing new cots in place for reuse of the spinning rollers. The apparatus provides a drive motor for powering a pair of wire cleaning brushes, tiltable apparatus for holding the spindles to be cleaned while engaged with the brushes, means for driving the spindles to be cleaned in a direction opposite to the direction of rotation of the wire brushes, means for ejecting the cleaned spindles from the holding apparatus and catching means for the cleaned spindles.

8 Claims, 14 Drawing Figures

TEXTILE SPINDLE CLEANING APPARATUS

DESCRIPTION

1. Technical Field

The present invention relates to cleaning equipment and more particularly to a machine for removing deposits of glue and cot debris from the spindles of spinning rollers once the old cots have been removed and prior to glueing new cots in place.

2. Background Art

Prior art U.S. Pat. Nos. 2,022,832; 2,052,482; 2,385,039; 2,443,002; 2,739,326; 2,785,423; 2,832,084; 2,852,792 and 3,605,156 are illustrative of various cleaning machines and apparatus which have been introduced for cleaning cylindrical roller members but which are not satisfactory for cleaning glue and cot debris from spinning rollers.

Thus, a conventional means of cleaning spindles of this type has been to manually hold a spindle against a buffing wheel. The user's fingers are exposed to injury from the cleaning apparatus and bristles flying from the buffing wheel have proven to be hazardous. This manual means for cleaning spindles is also very time consuming.

DISCLOSURE OF INVENTION

In accordance with the present invention, applicant provides an apparatus for cleaning textile machine spinning roller spindles from which the cots have been stripped and consisting of a frame having legs for supporting the apparatus on the floor, a drive motor for powering a pair of wire cleaning brushes, tiltable spindle holding apparatus, means for driving the spindle to be cleaned in a direction opposite to the direction of rotation of the wire brushes, means for ejecting the cleaned spindle from the holding apparatus and spindle catching means.

The spindle to be cleaned is placed in the holding apparatus and the forward tilting motion of the holding apparatus locks the spindle in place and begins rotation of the spindle. The holding device is tilted forward until the locked rotating spindle engages the wire brushes rotating in an opposite direction. The wire brushes strip old glue and other cot debris from the spindle. The tiltable holding apparatus is then moved back to its original starting position during which movement the spindle is ejected from the holding apparatus and is guided into a catching tray.

BRIEF DESCRIPTION OF DRAWINGS

Throughout the drawings, the usual drive, shaft and like safety guards typical of the type apparatus illustrated have not been shown for purposes of clarity.

BEST MODE FOR CARRYING OUT THE INVENTION

Figure 2:
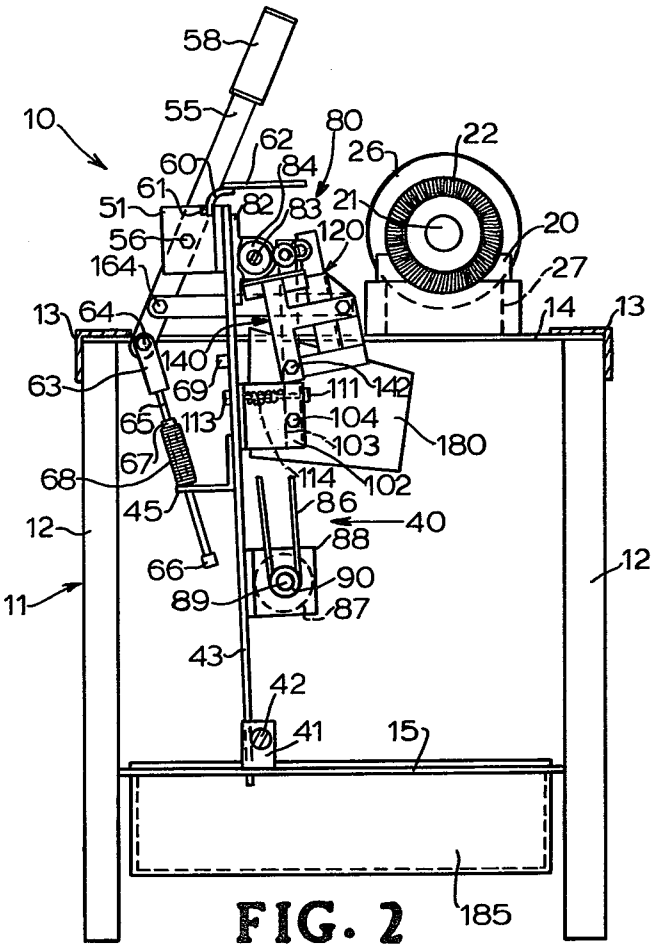
FIG. 2 is a side elevation view similar to that of FIG. 1 but with the spindle to be cleaned engaged and being held by the holding mechanism.

Referring to the drawings, a cleaning apparatus 10 for cleaning textile machine spinning roller spindles, constructed in accordance with the present invention, utilizes a frame 11 having vertical legs 12 and horizontal channel members 13. Channel members 13 form the front and rear top frame edges. Extending from one channel member 13 to the other are upper bracing members 14. Also extending across the base of apparatus 10 are lower brace members 15.

Bearing blocks 20 are mounted on selected ones of upper bracing members 14. Bearing blocks 20 mount a shaft 21 which in turn mounts a powered brush structure illustrated as a pair of wire brush members 22. Coupling 23 is secured to the free end of shaft 21 and receives in a mating manner coupling 24 which is secured to shaft 25. Electric drive motor 26 is fixedly secured to motor mount 27 which is secured to selected ones of bracing members 14. Motor 26 drives shaft 25 which through couplings 23, 24 and bearing blocks 20 drive shaft 21 and wire brushes 22 about a fixed horizontal axis. Motor 26 is powered from an external electrical power source through cord 28. In one embodiment, motor 26 was designed and geared so to drive wire brushes 22 at 1,740 rpm.

Turning now to a detailed description of the tiltable spindle holding apparatus 40, brackets 41 are fixed to selected ones of lower bracing members 15. Brackets 41 rotatably receive shaft 42 therein, the axis of which is horizontal, below and parallel to the axis about which brushes 22 rotate. Integrally secured to shaft 42 between brackets 41 is an elongated mounting plate 43. Plate 43 is secured by welding or other suitable means to shaft 42 and thus is pivotal therewith. An angle bracket 45 is integrally secured to the outside surface of plate 43 by welding or other suitable means. The function of bracket 45 is later described.

A pair of opposed angle brackets 50, 51 are integrally mounted on the outside surface of plate 43 adjacent the top or free end and substantially midway the width of plate 43. Operating handle 55 is pivotally mounted between brackets 50, 51 by bolt 56 and nut 57. The upper free end of handle 55 has a hand grip 58 mounted thereon. Angle bracket 51 also has a bracket 60 mounted thereon by bolt 61 which in turn has a transparent shield 62 secured by suitable means to bracket 60 and extending forward toward the inside of frame 11.

Handle 55, previously mentioned, can pivot forward or backward about bolt 56. Handle 55, in certain positions thereof, rest against front horizontal channel member 13 of frame 11, as seen in FIGS. 1, 2, 3, 4, 6, 8 and 10. The lower end of handle 55 pivots about bolt 64 between U-member 63. The lower end of U-member 63 has an integral rod member 65 which extends downward and passes through an opening (not shown) in a portion of angle bracket 45. Rod 65 is of a predetermined length and has a stop block 66 integrally secured to its lowermost end so that rod 65 cannot pass through angle bracket 45. A second stop block 67 is integrally mounted on the upper portion of rod 65 and compression spring 68 is mounted on rod 65 between stop block 67 and angle bracket 45. Thus, forward movement of handle 55 allows for expansion of spring 68 and rearward movement of handle 55 causes compression of spring 68 between stop block 67 and angle bracket 45. Stop 69 on plate 43 provides the forward limit for the lower end of handle 55, see FIG. 1.

Turning now to the spindle receiving, locking, driving and ejecting mechanism 80, a pair of bearing blocks 81, 82 are fixedly secured to the inside surface of plate 43 and are situated adjacent the top edge thereof. Extending between and rotatably received by bearing blocks 81, 82 is shaft 83. Shaft 83 in turn has a spline roller 84 fixedly mounted thereon. The end of shaft 83 received by bearing block 82 extends therethrough and mounts thereon a sprocket 85 which rotates with shaft 83. Sprocket 85 mounts chain 86 which is driven by a motor 87 mounted on motor mount bracket 88 on the inside lower surface of plate 43 (see FIGS. 1, 2, 5, 6 and 9). Motor mount bracket 88 is fixedly secured to plate 43. Motor 87 drives shaft 89 which has sprocket 90 mounted thereon. Motor 87 through sprocket 90 and chain 86 drives sprocket 85 and in turn spline roller 84. In the same embodiment in which brushes 22 were driven at 1,740 rpm, spline roller 84 was driven at approximately 16 rpm.

Figure 13:
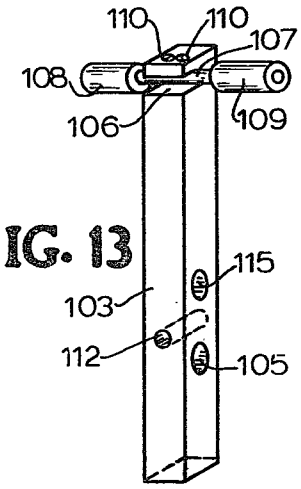
FIG. 13 is a perspective view of the spindle drive mechanism.

Another pair of brackets 101, 102 are fixedly secured to the inside surface of plate 43. Brackets 101, 102 receive pivotally therebetween post member 103 which is mounted between brackets 101, 102 on bolt 104. Bolt 104 passes through hole 105 in post member 103 as seen in FIG. 13. Post member 103 has a U-slot 106 in the upper side thereof which receives shaft 107. Shaft 107 receives on either end thereof rotatable intermediate rolls 108, 109. Shaft 107 is fixedly held in U-slot 106 of post member 103 by set screws 110 as seen in FIG. 13. Shaft 107 is held fixed by set screws 110 but allows rolls 108, 109 to rotate on shaft 107. Thus, post member 103 and rolls 108, 109 on shaft 107 may move forward and backward as post member 103 pivots about bolt 104. A rod 111 passes through hole 112 in post member 103 (see FIG. 13) and passes between brackets 101, 102 and through plate 43 where a nut 113 is placed thereon thus holding rod 111 in place. Compression spring 114 is mounted on rod 111 between plate 43 and the post member 103 (see FIGS. 1, 2, 5 and 6). Spring 114 thus tends to force post member 103 away from plate 43 and in turn maintains intermediate rolls 108, 109 out of contact with spline roller 84. However, when spline roller 84 and intermediate rolls 108, 109 are placed in contact with each other as later described, spline roller 84 is driven in a clockwise direction (as viewed in FIG. 5) and thus drives intermediate rolls 108, 109 in a counterclockwise direction and about a horizontal axis parallel to the axis about which brushes 22 rotate.

Figure 14:
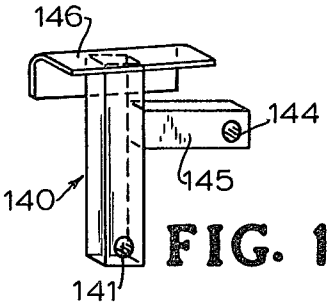
FIG. 14 is a perspective view of the spindle ejecting mechanism.
Figure 12:
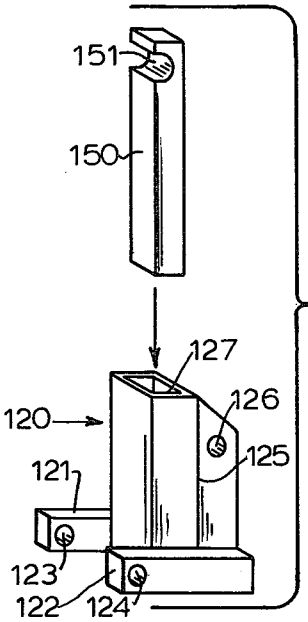
FIG. 12 is an exploded perspective view of the spindle holding member and related mechanism.

Post member 103 also mounts spindle holding member 120 (see FIG. 12) and spindle ejecting member 140 (see FIG. 14). Spindle holding member 120 has leg members 121, 122 which fit around post member 103 and which have holes 123, 124, respectively, which align with hole 115 in post member 103. Spindle ejecting member 140 resides adjacent leg member 122 of a spindle holding member 120 and hole 141 of spindle ejecting member 140 aligns with hole 124 of leg member 122. A bolt 142 passes through holes 141, 124, 115 and 123 with nut 143 (not shown) holding these members together in a pivoting relationship with each other. The axis of bolt 142 about which such pivoting takes place is below and parallel to the axis about which the spindle rotates during cleaning. Vertical portion 125 of spindle holding member 120 has a hole 126 which aligns with hole 144 in arm portion 145 of spindle ejecting member 140. A linkage arm 160 (FIG. 10) has a hole 161 which aligns with holes 126 and 144 with linkage arm 160 residing between arm portion 145 and vertical portion 125. Bolt 162 passes through holes 144, 161 (not shown) and hole 126. Nut 163 holds these parts together in a pivoting relationship. Linkage arm 160 extends from its connection with spindle holding member 120 and spindle ejecting member 140 to its point of connection with handle 55. Bolt 164 passes through linkage 160 and handle 55 with a nut 165 holding these members together also in a pivoting manner. Linkage arm 160 is connected to handle 55 at a location substantially midway between bolts 56 and 64. It can be seen that movement forward or backward of handle 55 thus causes, through linkage arm 160, for spindle ejecting member 140 and spindle holding member 120 to have limited pivoting therebetween.

Figure 11:
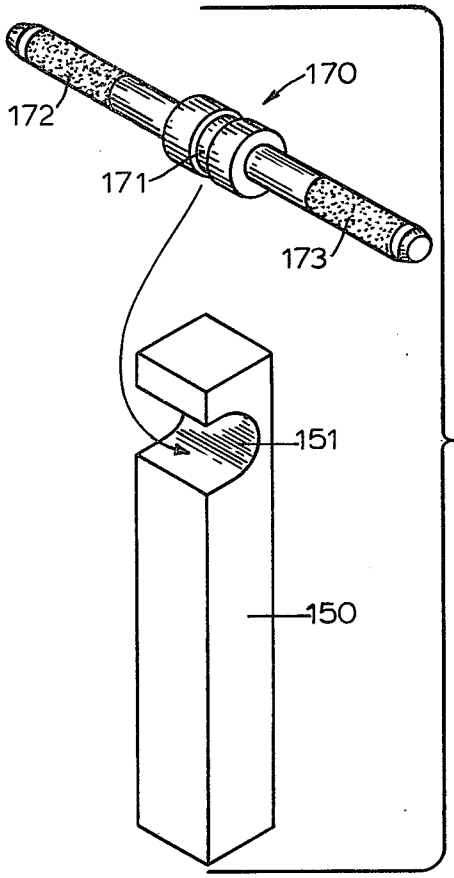
FIG. 11 is an exploded enlarged perspective view of the spindle holding member and the typical spindle, stripped of the cots, of the type cleaned by the invention apparatus.

Vertical spindle receiving post member 150 resides in hole 127 of spindle holding member 120 (see FIG. 12) with slot 151 facing in the direction of handle 55. FIG. 11 illustrates how the central bearing portion of spindle 170 fits into slot 151 of vertical spindle receiving post member 150. The central bearing portion 171 of spindle 170 thus resides in slot 151 of vertical spindle receiving post member 150 and is held therein by intermediate rolls 108, 109 which push against the outer end shaft portions 172, 173 of spindle 170. It is the outer ends of shaft portions 172, 173 which have glue and other cot debris, shown as stipled areas in FIG. 11, which must be removed before new cots can be installed and reused as spinning rolls.

Figure 10:
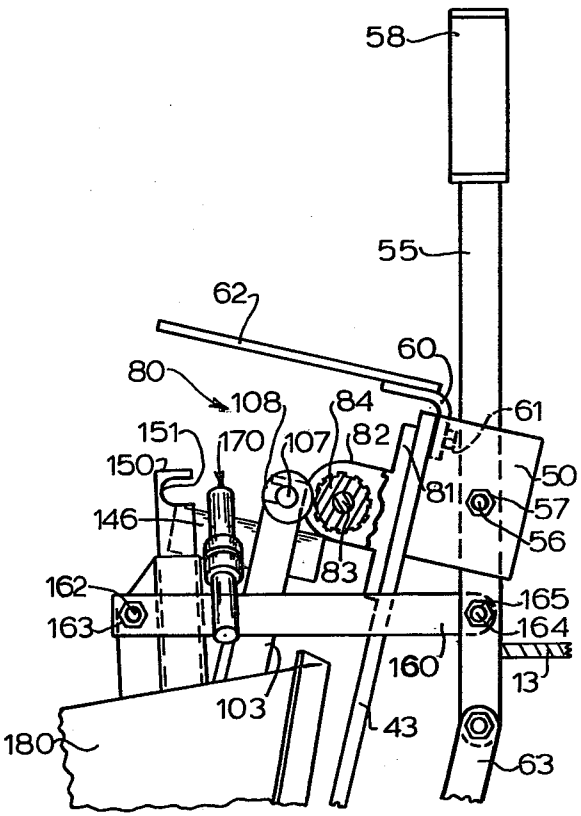
FIG. 10 is a fragmentary enlarged partially sectioned view illustrating the spindle ejection operation and guide apparatus.
Figure 9:
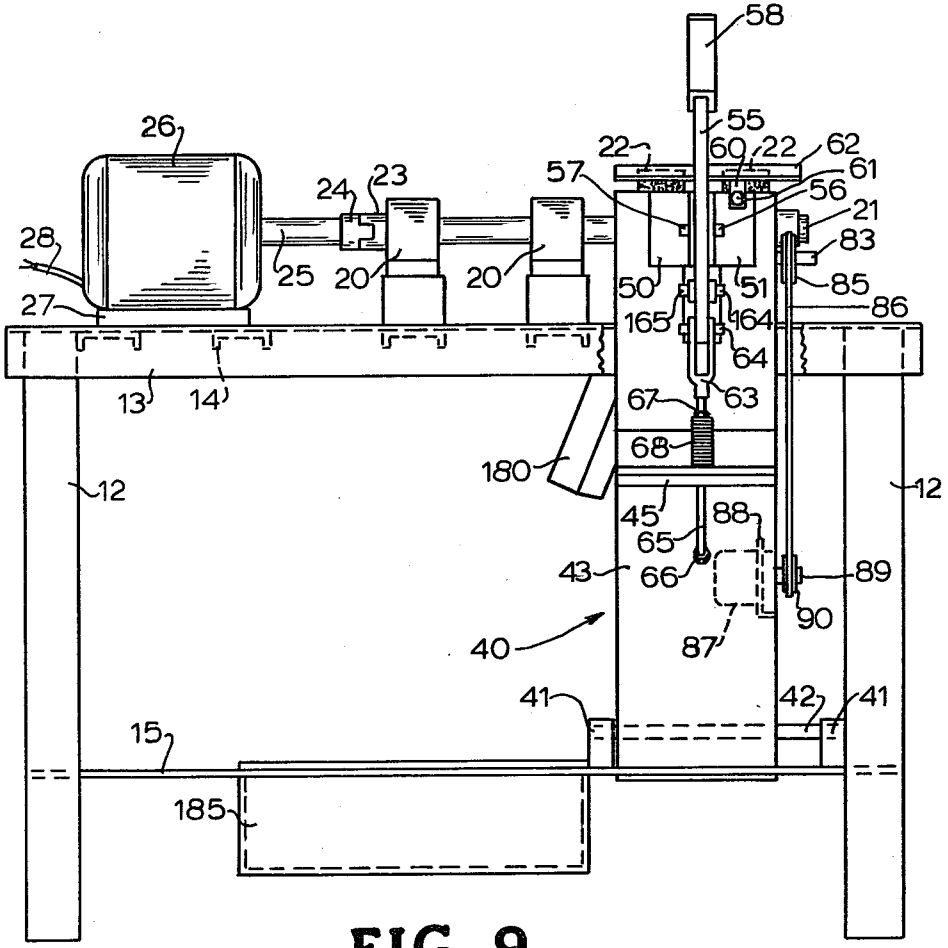
FIG. 9 is a front elevation view of the invention apparatus with a portion of the frame broken away and with the apparatus in the FIG. 5 spindle cleaning position.

A spindle guide 180 (FIG. 9) is secured by suitable means to the outside surface of bracket 101 and serves to guide spindle 170 as it is ejected from the spindle mechanism 80. Guide 180 is sloped downward as seen in FIGS. 9 and 10, and bumper 146 of spindle ejecting member 140 contacts shaft portion 172 and tips it towards guide 180. Spindle 170, once cleaned, slides down guide 180 and drops into spindle receiving pan 185 held by lower bracing members 15 (see FIG. 9).

In operation, a supply of spindles 170 previously stripped of the cots and having glue and other debris on the outer end shaft portions 172, 173 are delivered to the operator of the apparatus 10 of the invention. Handle 55 and its associated mechanism start in the position illustrated in FIG. 1. At this stage, spline roller 84 is being driven by motor 87 but is not in contact with intermediate rolls 108, 109 and brushes 22 are being driven by motor 26. A selected spindle 170 to be cleaned is placed in slot 151 of member 150 and handle 55 is snapped forward quickly to the FIG. 2 position. At this stage, spline roller 84 is in contact with intermediate rolls 108, 109 which in turn are in contact with shaft portions 172, 173 of spindle 170. Spindle 170 is thus held in place and is being driven by intermediate rolls 108, 109 but in a direction opposite to the direction in which brushes 22 are being driven and at substantially less speed. Next, spindle receiving, locking, driving and ejecting mechanism 80 is moved forward to the FIG. 5 position with the rapidly revolving wire brushes 22 being placed in contact with shaft portions 172, 173 to be cleaned and with spindle 170 being rotated relatively slowly clockwise and wire brushes 22 being rotated relatively rapidly counterclockwise, as viewed in FIG. 5, the glue and debris are cleaned from the outer end shaft portions 172, 173. Spindle 170 may be forced into contact with wire brushes 22 with whatever force is desired by pushing forward on handle 55. Transparent shield 62 allows the operator to view the cleaning of spindle 170 but prevents wire bristles or debris from being thrown into the operator's eyes and other drive safety guards, not shown, protect the operator from injury. After shaft portions 172, 173 are cleaned, handle 55 and its associated mechanism are snapped back into the FIGS. 6 and 10 postion at which time spline roller 84 is moved out of engagement with immediate rolls 108, 109 and rolls 108, 109 are no longer in contact with shaft portions 172, 173. The now cleaned spindle 170 is bumped by bumper 146 and ejected from spindle holding member 120 traveling down spindle guide 180 into spindle receiving pan 185.

Figure 1:
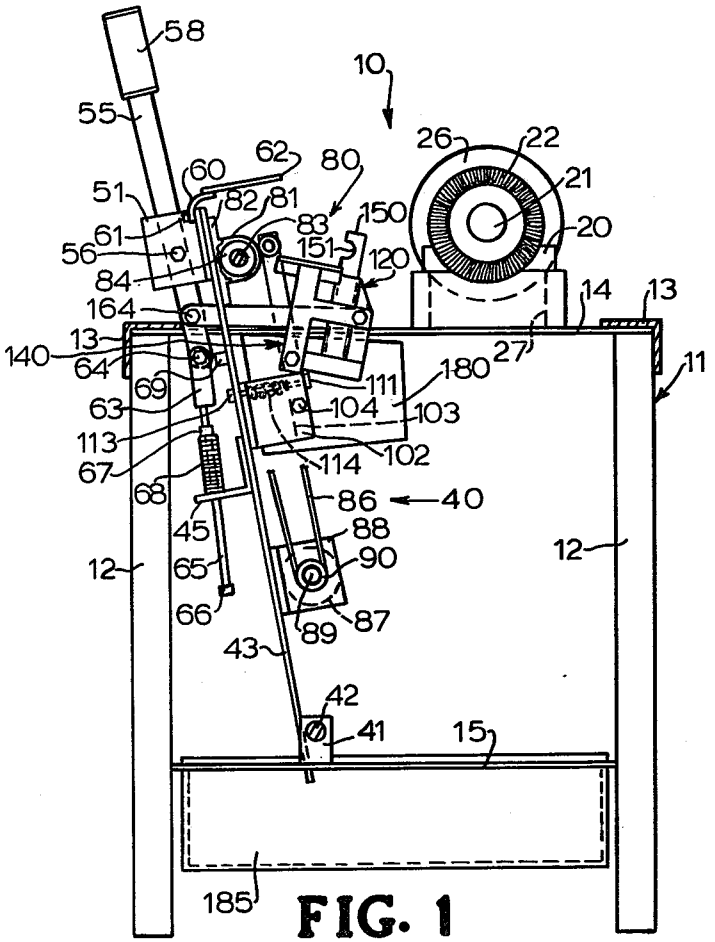
FIG. 1 is a partially sectioned, fragmentary side elevation view of the apparatus of the present invention with the spindle receiving and holding mechanism in a retracted position.
Figure 3:
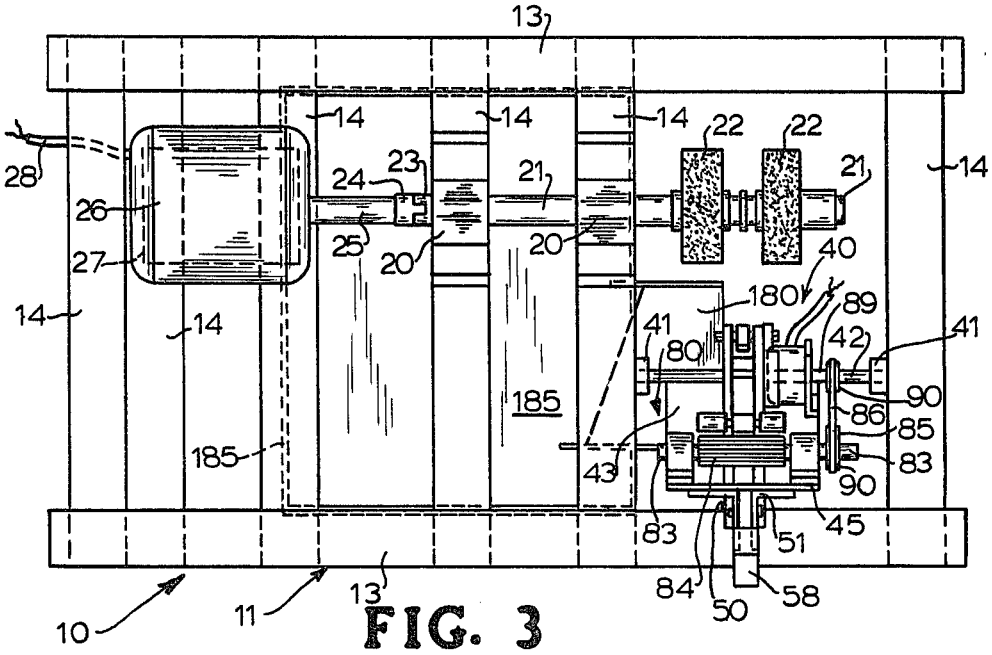
FIG. 3 is a top plan view of the FIG. 1 apparatus and position with the usual eye shield not shown for purposes of clarity.
Figure 4:
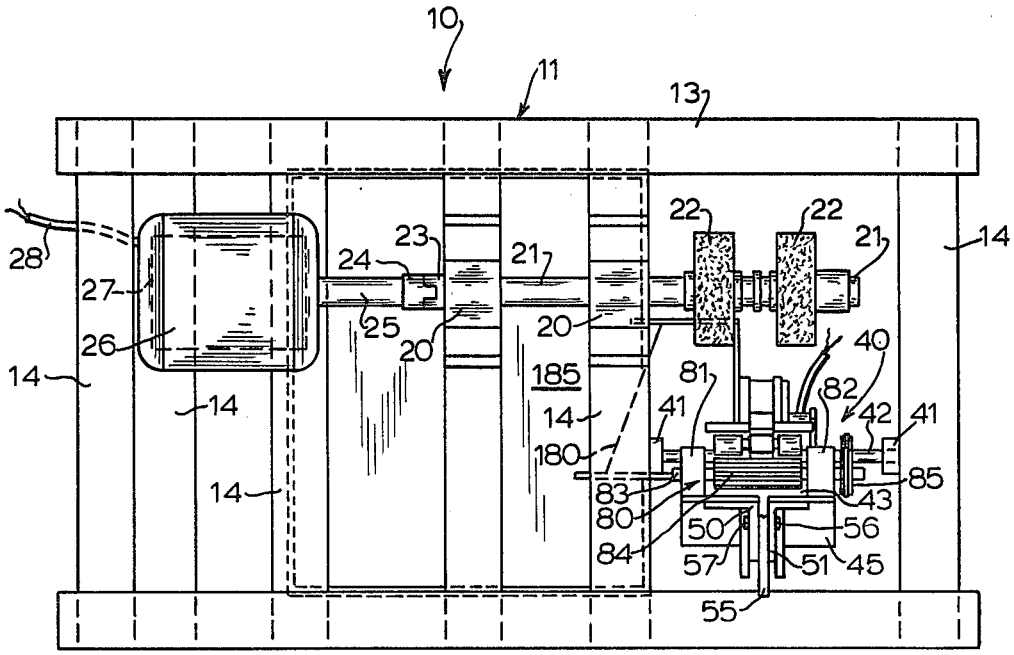
FIG. 4 is a top plan view of the FIG. 2 apparatus and position also with the eye shield removed for purposes of clarity.
Figure 6:
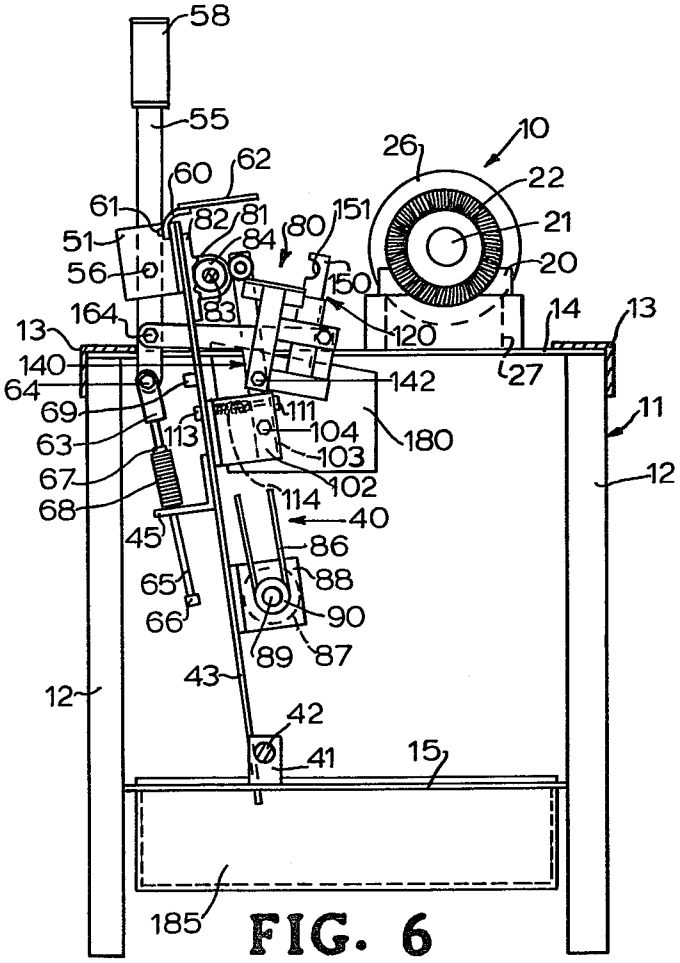
FIG. 6 is a side elevation view similar to that of FIGS. 1, 2 and 5 but with the spindle holding mechanism in the ejection position.
Figure 5:
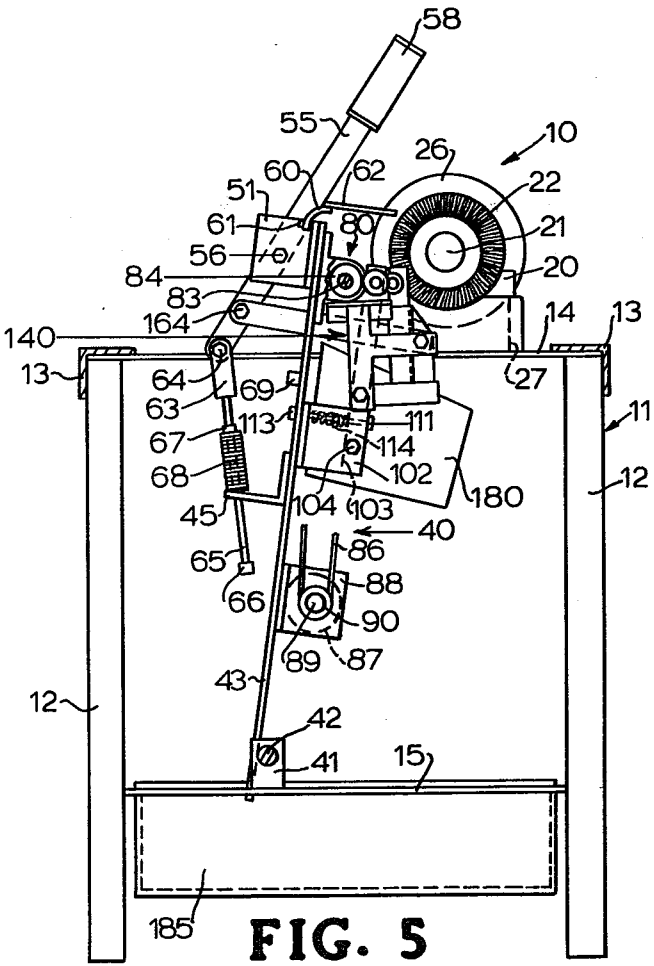
FIG. 5 is a side elevation view similar to that of FIGS. 1 and 2 but showing the spindle in contact with the cleaning wire brushes.
Figure 7:
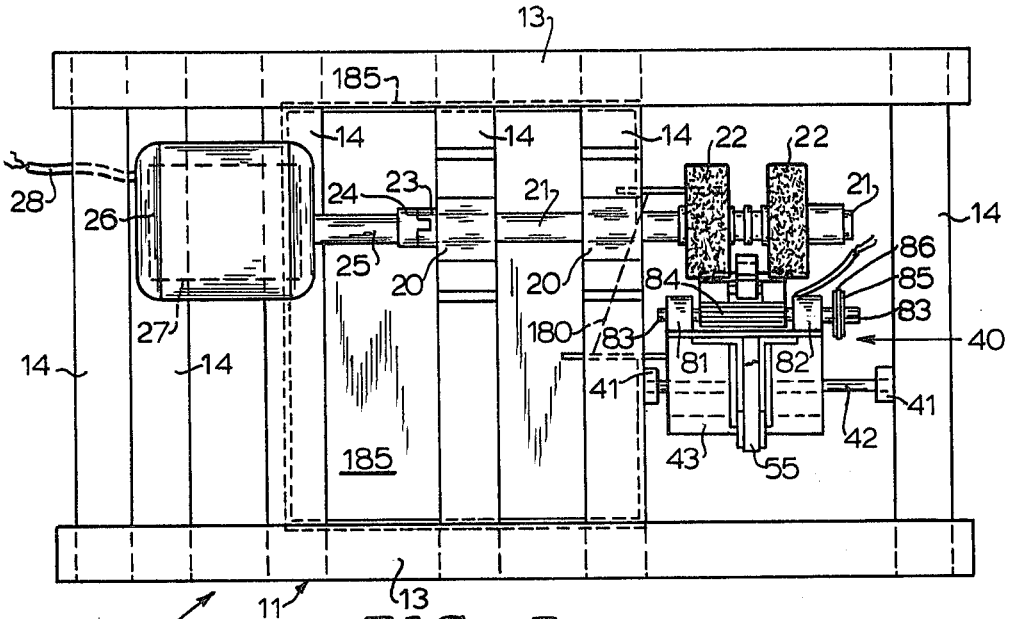
FIG. 7 is a top plan view of the FIG. 5 apparatus and position but with the usual eye shield not shown for purposes of clarity.
Figure 8:
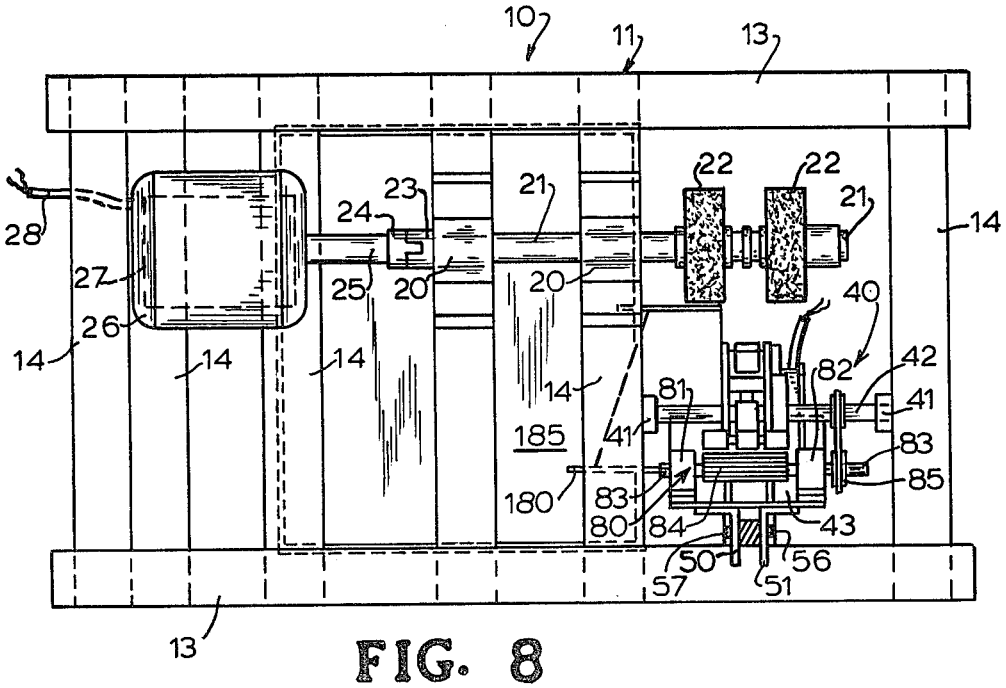
FIG. 8 is a top plan view of the FIG. 6 apparatus and position also with the usual eye shield not shown for purposes of clarity.

The mechanism is then moved back to the FIG. 1 position and the process is repeated for each spindle requiring cleaning. Apparatus 10 is manually loaded and unloaded by the operator thus giving the operator full control over the degree to which shaft portions 172, 173 are cleaned.

From the foregoing, it can be seen that there has been provided a means by which a spinning roller after having its cots removed can be quickly cleaned to remove the glue and debris. Further, with little expertise, an operator can very rapidly acquire the knack of being able to snap the operating handle and its lever back and forth and load the spinning rollers to be cleaned in rapid succession as the cleaned rollers drop out automatically in rapid sequence.

What is claimed is:

1. An apparatus for cleaning dried glue, cot debris, and the like, from the cot-mounting shaft portions extending outwardly from the bearing portion of a textile spinning roller spindle from which the cots have been stripped, comprising:

(a) a frame;

(b) powered brush structure mounted and rotatable about a fixed axis on said frame and having cleaning brush surfaces adapted when engaged with the cot mounting end shaft surfaces of a cot stripped spindle to clean such surfaces of glue, cot particles, and the like;

(c) spindle support structure mounted for tilting about a fixed axis on said frame parallel to said brush structure axis rearwardly to a spindle loading position, forwardly to a spindle cleaning position and therebetween to a discharge position at which the cleaned spindle is ejected, said spindle support structure including and having mounted thereon:

(i) holder means positionable for receiving and releasably locking the central bearing portion of a cot stripped spindle to be cleaned enabling the same to rotate about an axis parallel to the axis of rotation of said brush structure when the outer cot supporting shaft ends of said spindle are engaged with and being cleaned by said brush surfaces in said cleaning position;

(ii) drive means adapted to drive said stripped spindle being cleaned during the cleaning of said outer shaft ends and at a speed different from the speed at which said brushes are driven; and (iii) an operator handle and associated linkage interconnected with said holder means and being adapted in said loading position to present said holder means for receiving a cot stripped spindle to be cleaned, to thereafter be moved to a locking position wherein said central bearing portion of said stripped spindle being cleaned is releasably locked in said axially parallel position and said drive means is engaged to drive said stripped spindle being cleaned, to then move the rotating said stripped spindle to be cleaned to said cleaning position to engage the outer shaft ends thereof with said brush surfaces for cleaning and after said cleaning to eject the cleaned spindle and restore said holder means to said loading position and with said drive means in a disengaged position.

2. An apparatus as claimed in claim 1 wherein said brush means revolves at a speed substantially in excess of the speed at which said drive means drives the said stripped cot spindle being cleaned and in an opposite direction.

3. An apparatus as claimed in claim 1 wherein said powered brush structure comprises a pair of laterally spaced wire brushes arranged such that each one of said brushes engages a respective one of said spindle outer ends to be cleaned when in said cleaning position.

4. An apparatus as claimed in claim 1 including means for guiding the cleaned said spindle once ejected from said holder means into a cleaned spindle receiving container.

5. An apparatus as claimed in claim 1 wherein that portion of said holder means adapted to releasably hold said central bearing portion of the said spindle to be cleaned tilts on said support structure about an axis below and parallel to the axis about which said spindle rotates during cleaning.

6. An apparatus as claimed in claim 1 wherein the said fixed axis about which said spindle support structure tilts is below the level of said brush structure axis.

7. An apparatus as claimed in claim 6 wherein said powered brush structure comprises a pair of laterally-spaced wire brushes arranged such that each one of said brushes engages a respective one of said spindle outer ends to be cleaned when in said cleaning position and said pair of brushes revolve at a speed substantially in excess of the speed at which said drive means drives the said stripped cot spindle being cleaned, wherein that portion of said holder means adapted to releasably hold said central bearing portion of the said spindle to be cleaned tilts on said support apparatus about an axis below and parallel to the axis about which said spindle rotates during cleaning and including means for guiding the cleaned said spindle once ejected from said holder means into a cleaned spindle receiving container.

8. An apparatus for cleaning dried glue, cot debris, and the like from the cot-mounting shaft portions extending outwardly from the central bearing portion of a textile spinning roller spindle from which the cots have been stripped, comprising:

(a) a frame;

(b) powered brush structure mounted and rotatable about a fixed axis on said frame and having cleaning brush surfaces adapted when engaged with the cot-mounting end shaft surfaces of a cot-stripped spindle to clean such surfaces of glue, cot particles, and the like; and (c) spindle support and drive structure mounted for tilting about a fixed axis on said frame parallel to said brush structure axis and towards and away from said brush structure, said spindle support and drive structure including an operator handle, associated operating linkage, spindle holding and spindle drive means enabling the central bearing portion of a stripped spindle to be cleaned to be releasably grasped such that the spindle may rotate about its own axis during cleaning, to be driven during cleaning, to be moved into a cleaning position for engagement of the stripped spindle outer ends with the brush structure while being driven at different speeds and after being cleaned to be ejected preparatory to loading another stripped spindle for cleaning.

* * * * *